US006857508B2

(12) United States Patent
Miller et al.

(10) Patent No.: US 6,857,508 B2
(45) Date of Patent: Feb. 22, 2005

(54) ELEVATOR HOIST MACHINE INSTALLATION APPARATUS

(75) Inventors: Michael G. Miller, Littlestown, PA (US); Daniel Corcoran, Morris Plains, NJ (US); Scott Carlton Conrey, Hamburg, NJ (US); Alessandro Cercone, West Paterson, NJ (US)

(73) Assignee: Inventio AG, Hergiswil (CH)

( * ) Notice: Subject to any disclaimer, the term of this patent is extended or adjusted under 35 U.S.C. 154(b) by 153 days.

(21) Appl. No.: 10/285,247

(22) Filed: Oct. 31, 2002

(65) Prior Publication Data

US 2004/0084251 A1 May 6, 2004

(51) Int. Cl.[7] ..... B66B 11/02
(52) U.S. Cl. ..... 187/401; 187/900
(58) Field of Search ..... 187/222, 225, 187/226, 233, 401, 402, 900, 414; 182/2.3, 2.11, 2.6, 38, 141–149, 128, 103; 414/10–12, 628–638, 272, 281, 284, 544, 592, 600, 603, 605

(56) References Cited

U.S. PATENT DOCUMENTS

| | | | | | |
|---|---|---|---|---|---|
| 2,787,278 | A | * | 4/1957 | Mitchell | 4/626 |
| 3,240,372 | A | * | 3/1966 | Joyce et al. | 414/631 |
| 4,311,434 | A | | 1/1982 | Abe | |
| 4,546,854 | A | * | 10/1985 | Bocker | 182/103 |
| 4,710,091 | A | * | 12/1987 | Ochiai et al. | 414/623 |
| 4,793,437 | A | * | 12/1988 | Hanthorn | 182/102 |
| 4,797,055 | A | * | 1/1989 | Tworoger et al. | 414/283 |
| 5,833,031 | A | * | 11/1998 | Liebetrau et al. | 187/239 |
| 5,915,913 | A | * | 6/1999 | Greenlaw et al. | 414/679 |
| 6,357,556 | B1 | * | 3/2002 | Pettersson et al. | 187/414 |
| 6,422,352 | B1 | * | 7/2002 | Pettersson et al. | 187/408 |
| 6,595,330 | B1 | * | 7/2003 | Henrickson et al. | 187/277 |

FOREIGN PATENT DOCUMENTS

| | | |
|---|---|---|
| EP | 1 245 522 | 10/2002 |
| JP | 2000/034072 A | 2/2000 |

* cited by examiner

*Primary Examiner*—Jonathan Salata
(74) *Attorney, Agent, or Firm*—MacMillan, Sobanski & Todd, LLC

(57) ABSTRACT

An apparatus or tool for installing an elevator hoist machine to a support at the top of the vertically extending guide rails. The apparatus includes a carriage for imparting vertical movement to move the hoist machine to the upper end of the guide rails and then horizontal movement thereto at the upper ends of the guide rails to enable hoist machines to be installed in areas with limited ceiling height.

10 Claims, 1 Drawing Sheet

ELEVATOR HOIST MACHINE INSTALLATION APPARATUS

BACKGROUND OF THE INVENTION

The present invention relates generally to elevator hoisting machines and more particularly to an apparatus or tool for installing an elevator hoist machine in an elevator hoistway typically on the upper terminal end of the guide rails in an elevator hoistway.

The prior art discloses certain apparatus capable of mounting an elevator hoist machine in the vicinity of the ceiling of an elevator hoistway wherein the clearance between the ceiling and the support for the hoist machine is minimal.

A publication No. 2000034072A of a Japanese patent application No. 10203378 discloses a mounting device for an elevator hoisting machine equipped with a loading space part mounted with a hoisting machine, a load lifter consisting of a counterweight frame extendedly installed in a position lower than the loading space part. A winch is provided in the lower part of the hoistway to effectively lift the load lifter and the hoisting machine up to the vicinity of the ceiling of the hoistway. When the hoisting machine is lifted up to the vicinity of the ceiling of the hoistway by means of suitably provided lifting ropes, interference between other members is avoided.

Other means for installing hoist machines in elevator hoistways permit the hoisting and positioning of the machine from lifting beams above the supporting structure and lifting attachments above the bottom of the machine.

SUMMARY OF THE INVENTION

The present invention relates to an apparatus for installing an elevator hoist machine in an elevator hoistway capable of lifting the machine in an open elevator shaft area between guide rails with means to position the machine over supporting structure of the top of the rails.

The apparatus or tool for installing an elevator hoist machine to a machine support affixed to generally vertically extending guide rails within an elevator hoistway, comprises a carriage for conveying the hoist machine with an associated elevator hoistway; a support for the carriage, the support including a generally horizontally extending beam member, the beam member extending outwardly into the elevator hoistway and terminating in spaced relation from the guide rails, wherein the carriage may be selectively positioned on the support; and an attachment assembly for attaching the support to a hoist for imparting selective vertical movement of the carriage and the support along the guide rails within any elevator hoistway to deliver a hoist machine to position of use on the machine support.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
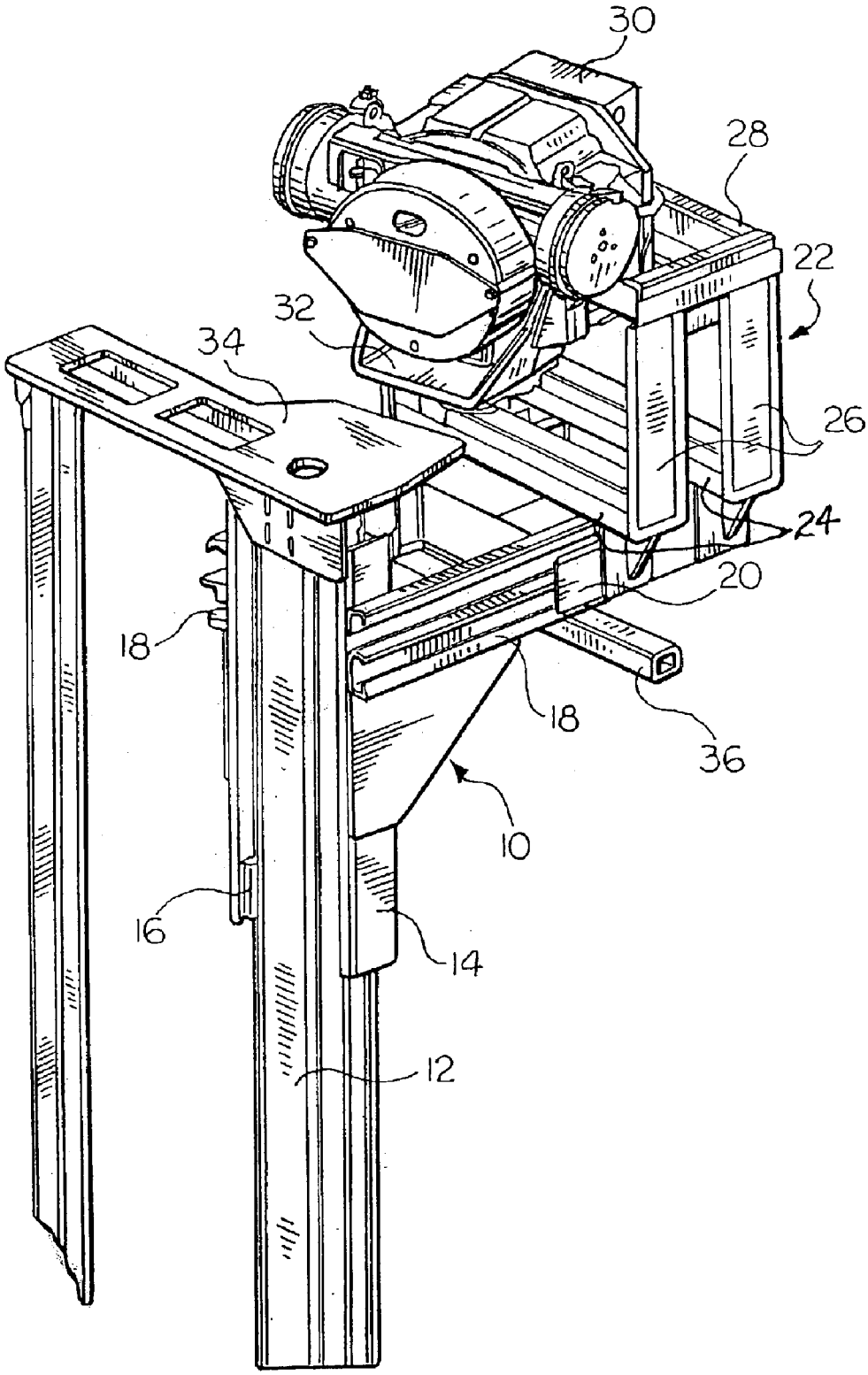
FIG. 1 is a fragmentary perspective of a guide rail structure for an elevator in an elevator hoistway showing an apparatus containing the features of the invention for installing an elevator hoist machine to a machine support affixed to the upper end of generally vertically extending guide rail assembly.

Referring to the drawing, there is illustrated a tool for installing elevator hoist machines in an elevator hoistway. The tool or system has been found to be particularly useful to lift, lower, and position a hoist machine in a hoistway that does not have a conventional machine room.

The illustrated embodiment consists of a structural frame 10 adapted to be assembled around an elevator guide rail 12 designed to extend vertically within an elevator hoistway. The elevator guidance system may be of the type manufactured and sold by Schindler Elevator Corporation and designated as a tri-rail elevator guidance system. In such a system, the structural frame 10 is assembled around the three rails of a tri-rail elevator guidance system.

The main frame 10 includes vertical upright members 14 and guide shoes 16. The guide shoes 16 typically interface with the guiding surfaces of the rails 12 to provide for relative vertical movement of the upright members 14 on the guide rails 12. The main frame 10 also functions as a guide means for the carriage 22 and includes spaced apart guide members 18 connected to the vertical upright members 14 and containing guide shoes 20 coupled thereto for relative horizontal movement thereon.

A hoist machine carriage 22 is connected to the guide shoes 20. The carriage 22 includes horizontal base members 24 coupled to the guide shoes 20, upstanding vertical members 26, and an upper frame 28 integral with the upper ends of the vertical members 26. The carriage 22 is provided to support a hoist machine 30. The hoist machine 30 includes a base 32 to be permanently affixed to a machine support 34 mounted on the upper terminal ends of the guide rails 12.

In order to impart vertical movement to the main frame 10 and the associated hoist machine carriage 22, there is provided an attachment means in the form of a beam 36 which extends below and is affixed to the spaced apart guide members 18.

It will be appreciated that initially the main frame 10 and the hoist machine carriage 22 are positioned at a lower level in the associated elevator hoistway to receive the hoist machine 30. The hoist machine 30 is typically positioned on the carriage 22 so that only minimal movement thereof will be required to effect proper alignment of the base 32 and the support 34. Once the hoist machine 30 is suitably positioned on the carriage 22, hoist ropes, not shown, are connected to the cross beam 36 and the entire main frame 10, the carriage support 22, and the hoist machine 30 are lifted to the uppermost position illustrated in FIG. 1. When the assemblage reaches this position, machine carriage 22 is caused to be slid horizontally over the horizontal guide members 18 to a position where the base 32 of the hoist machine 30 is superposed over the support 34 and the attachment holes are aligned. Finally, the main frame 10 is lowered slightly allowing the entire load of the hoist machine 30 to be carried by the support 34, and the machine carriage 22 is caused to be slid horizontally away from guide rails 12 and lowered to a lower position.

The aforedescribed system may be effectively utilized to lift, lower, and position an elevator hoist machine into operative position on the upper terminals of guide rails in an elevator hoistway which does not have a conventional machine room. Guidance for the system is typically achieved by the rails of a previously installed elevator guide rail system. Also, the system permits the location or placement of an elevator hoisting machine in the open elevator shaft area between the guide rails and provides a means to shift the position of the machine laterally over the machine supporting structure at the top of the guide rails. Further, the system may be satisfactorily used in low overhead shaft conditions where conventional hoisting means would require building alterations and could not be employed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for installing am elevator hoist machine to a machine support affixed at an upper end of a vertically extending guide rail within an elevator hoistway, comprising:

a carriage for supporting and conveying the hoist machine said carriage being shaped to superpose the hoist machine over the machine support;

a frame supporting said carriage and being vertically movable along the guide rail, said frame including guide means extending generally horizontally outwardly into the elevator hoistway and terminating in spaced relation from the guide rail, wherein said carriage is selectively horizontally movable on said guide means; and an attachment means connected to said frame for attaching said frame to a hoist for imparting selective vertical movement of said frame and said carriage along the guide rail to deliver the hoist machine to a position of use whereby said carriage can be moved horizontally to superpose the hoist machine over the machine support and said frame and said carriage can be lowered to position the hoist machine on the machine support.

2. The apparatus according to claim 1 wherein said guide means includes at least one guide shoe slidingly attaching said carriage to said frame.

3. The apparatus according to claim 1 wherein said guide means includes a pair of spaced apart guide members supporting said carriage for movement of said carriage toward and away from the guide rails.

4. The apparatus according to claim 1 wherein said carriage includes at least one base member movably mounted on said frame, an upper frame spaced above said at least one base member for releasably supporting the hoist machine and at least two vertical members connecting said upper frame to said at least one haze member and being spaced apart a distance sufficient to receive the machine support therebetween.

5. An apparatus for installing an elevator hoist machine to a machine support affixed to a top of a vertically extending guide rail within an elevator hoistway, comprising:

an elevator hoist machine carriage including an upper frame for supporting a hoist machine above the machine support;

a structural frame adapted to be mounted on the guide rail for vertical movement thereon; and at least one guide shoe slidingly attaching said carriage to said structural frame to enable said carriage to move horizontally toward and away from the guide rail, said upper frame being spaced above said structural frame a distance sufficient to enable entry of the machine support therebetween.

6. The apparatus according to claim 5 wherein said structural frame includes a pair of spaced apart guide members slidingly engaged by said at least one guide shoe and another guide shoe.

7. The apparatus according to claim 5 including an attachment means connected to said structural frame for attaching said structural frame to a hoist for imparting selective vertical movement of said structural frame and said carriage along the guide rail to deliver the hoist machine to a position of use on the machine support.

8. An apparatus for installing an elevator hoist machine to a machine support affixed to a vertically extending guide rail within an elevator hoistway, comprising:

a frame;

a first guide shoe attached to said frame for sliding engagement with the vertically extending guide rail permitting said frame to move vertically in the elevator hoistway;

an elevator hoist machine carriage for supporting the hoist machine; and a second guide shoe attached to said carriage for sliding engagement with said frame to permit horizontal movement of said carriage on said frame toward and away from the guide rail, said carriage being formed to support the hoist machine above said frame to permit entry of the machine support between the hoist machine and said frame.

9. The apparatus according to claim 8 wherein said frame includes at least one horizontally extending guide member slidingly engaged by said at least one guide shoe.

10. The apparatus according to claim 8 including an attachment means connected to said frame for attaching said frame to a hoist for imparting selective vertical movement of said frame and said carriage along the guide rail to deliver the hoist machine to a position of use on the machine support.

* * * * *